US006684425B2

(12) United States Patent
Davis

(10) Patent No.: US 6,684,425 B2
(45) Date of Patent: Feb. 3, 2004

(54) MATTRESS RETAINER FOR ADJUSTABLE BED

(76) Inventor: Edmund Scott Davis, 2305 Solar Plaza Dr., Ft. Lauderdale, FL (US) 33301

( * ) Notice: Subject to any disclaimer, the term of this patent is extended or adjusted under 35 U.S.C. 154(b) by 0 days.

(21) Appl. No.: 10/076,190

(22) Filed: Feb. 14, 2002

(65) Prior Publication Data

US 2003/0150058 A1 Aug. 14, 2003

(51) Int. Cl.[7] ..... A47C 21/06; A61G 7/015
(52) U.S. Cl. ..... 5/615; 5/660; 5/925
(58) Field of Search ..... 5/615, 660, 925, 5/926

(56) References Cited

U.S. PATENT DOCUMENTS

| | | | | | |
|---|---|---|---|---|---|
| 2,612,645 | A | * | 10/1952 | Boland | 5/644 |
| 3,392,412 | A | | 7/1968 | Aymar | |
| 3,426,373 | A | | 2/1969 | Scott et al. | |
| 3,606,623 | A | | 9/1971 | Aymar | |
| 3,667,075 | A | | 6/1972 | Ballard et al. | |
| 3,781,928 | A | | 1/1974 | Swallert | |
| 4,309,783 | A | | 1/1982 | Cammack et al. | |
| 4,527,298 | A | | 7/1985 | Moulton | |
| 4,554,693 | A | * | 11/1985 | Calloway | 5/925 X |
| 4,839,932 | A | | 6/1989 | Williamson | |
| 4,873,731 | A | * | 10/1989 | Williamson | 5/615 |
| 4,932,089 | A | * | 6/1990 | Laviero | 5/421 |
| 5,012,539 | A | * | 5/1991 | Grigg | 5/648 X |
| 5,170,522 | A | | 12/1992 | Walker | |
| 5,311,625 | A | * | 5/1994 | Barker et al. | 5/615 |
| 5,345,630 | A | * | 9/1994 | Healy | 5/615 X |
| 5,432,967 | A | * | 7/1995 | Raftery | 5/633 |
| 5,528,783 | A | * | 6/1996 | Kunz et al. | 5/615 X |
| 5,577,278 | A | * | 11/1996 | Barker et al. | 5/615 |
| 5,621,931 | A | * | 4/1997 | Hamilton | 5/925 X |
| 5,806,115 | A | * | 9/1998 | Brown | 5/615 |
| 2003/0041378 | A1 | * | 3/2003 | Davis | 5/615 |
| 2003/0150058 | A1 | * | 8/2003 | Davis | 5/615 |

* cited by examiner

*Primary Examiner*—Robert G. Santos
(74) *Attorney, Agent, or Firm*—Alston & Bird LLP

(57) ABSTRACT

The present invention is directed to a bed having a generally rectangular foundation and mattress, an air chamber located beneath having a plurality of sections, and at least one air chamber under a portion of the mattress, a controller for regulating the amount of air in the air chamber, and a mattress retainer placed between the mattress and the foundation comprising a tongue and extending toward the foot of the bed a sufficient distance to make contact with both the mattress and the foundation to increase the friction sufficiently to prevent slippage of the mattress when the heat is raised.

11 Claims, 4 Drawing Sheets

MATTRESS RETAINER FOR ADJUSTABLE BED

FIELD OF THE INVENTION

The present invention relates to a mattress retainer for an adjustable bed. More particularly, the invention relates to a retainer for preventing a mattress from sliding toward the foot of the bed when the portion of the mattress under the user's back and head is raised.

BACKGROUND OF THE INVENTION

Adjustable beds have found widespread use beyond non-ambulatory patients and are used in many homes among persons of all age groups, in particular beds that raise the head and back area. Among the devices used to raise the back and head are inflatable air bladders intended for use with conventional beds. However, frequently when the mattress is raised to its high point the bladder tends to slip out from between the mattress and the bed foundation or box springs. A number of patents have recognized this problem. For example U.S. Pat. Nos. 3,392,412 and 3,606,623 to Aymar provide a bedrest having a bellows placed under a mattress and filled with compressed air. To solve the problem, the bellows are preferably attached to the frame of the bed by straps. In addition, the bed rest includes plastic sheets that enclose the bellows and fit directly under the mattress to properly position the bellows.

Stabilizing the inflatable air bladders increases the tendency of the mattress to slide toward the foot of the bed when the air bladder is inflated. This problem has also been recognized. For example, the adjustable bed shown in U.S. Pat. No. 4,309,783 includes a hinged frame including inflatable bags is provided between a mattress and a box springs to individually elevate the different portions of the mattress. The inflatable bags are tied to the frame and the mattress is tied to the box springs and the frame.

Another adjustable bed is shown in U.S. Pat. No. 4,527,298 which discloses a pneumatically adjustable bed. The elevation of the back and leg sections are aided by a four piece bedboard which underlies the mattress and provides a surface against which the air bladders inflate to a particular area of the mattress. The pieces of the bedboard are hinged together and configured to underlie an inflatable mattress. The mattress is prevented from moving relative to the box springs by a central positioning strap to prevent the mattress from migrating when the bladder is inflated or deflated. In addition, the bladder that raises the head is positioned by means of a tie down strap.

It is an object of the present invention to provide a mattress retainer for use with an adjustable bed that prevents the mattress from sliding toward the foot of the bed when the air bladder is inflated. Another object of the present invention to provide an adjustable bed having an elevated back and head section including a mattress, foundation or box springs, and a mattress retainer for maintaining the mattress in its proper position on the foundation or box springs. It is a further object of the present invention to provide a mattress retainer for use with an adjustable bed that maintains the air bladder in its proper position while preventing the mattress from sliding toward the foot of the bed when the air bladder is inflated.

SUMMARY OF THE INVENTION

The above and other objects and advantages of the invention are achieved by the provision of a mattress retainer for use on a bed having the ability to raise and lower the head and back area of the mattress. The bed includes a foundation and a mattress. The adjustable feature of the bed includes an air chamber located beneath a portion of the mattress between the mattress and the box springs and positioned under the head and back portion of the user. The inflatable air chamber is interconnected to a controller for regulating the amount of air in the chamber. The mattress retainer includes a first retaining member that extends under the mattress toward the foot of the bed a sufficient distance to make contact with both the mattress and the foundation to increase the friction sufficiently to prevent slippage of the mattress when the head is raised. A second retaining member is attached to the first retaining member and formed so as to retain the foot of the mattress. The mattress retainer is placed between the mattress and the foundation or box springs.

In one embodiment, this first retaining member is a plurality of straps, generally two straps will sufficient. In another embodiment the first retaining member is a solid sheet of flexible material, such as a fabric or plastic material.

The second retaining member may have several embodiments including a rigid frame attached to the first member and positioned at the end of the foot portion of the mattress. In another embodiment the second retaining member encircles or encompasses the foot portion of the mattress bed and may be of a mesh or net-like material.

In another embodiment, end of the first retaining member opposite the second retaining member is attached or affixed to the inflatable air bladder. In this embodiment, both the mattress and the air bladder are maintained in position. In one embodiment the first retaining member, especially I the form of a single sheet of material is coated with a non-skid material and may be attached to the bladder or a component that extends from it.

Thus, with the present invention there is provided a mattress retainer that is easy to install, simple in operation and one that may be used with a conventional bed. Further, the mattress retainer is effective to prevent the mattress from slipping toward the foot portion of the bed.

BRIEF DESCRIPTION OF THE DRAWINGS

Some of the objects and advantages of the present invention have been stated, other objects, features and advantages will become apparent from the following description taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
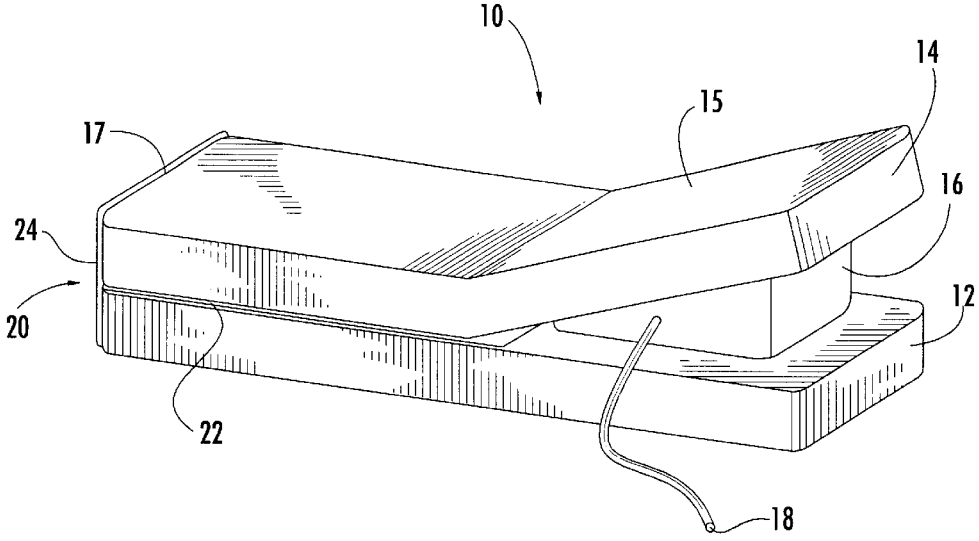
FIG. 1 illustrates an adjustable bed according to the present invention showing the back and head portion of the mattress in an elevated position and showing an embodiment of the mattress retainer between the mattress and the foundation.

Referring more particularly to the drawings, FIG. 1 shows an adjustable bed 10 for use with the present invention. The bed 10 is generally rectangular and has conventional box springs or other suitable foundation 12, a mattress 14. In other words the bed used with the present invention may be a conventional bed. The mattress 14 has a head/back portion 15 and a foot portion 17. An inflatable bladder 16 having an air supply tube 18 for inflating and deflating the bladder is provided for raising and lowering the head portion 15 of the mattress. The bladder 16 is preferably wedge shaped with a uniform height and width that extends at least most of the way across the width of the mattress 14. A mattress retainer 20 placed between the mattress 14 and the foundation 12. The position of the head/back portion 15 of mattress 14 is controlled by inflating and deflating air chamber 16 to raise or lower head/back portion mattress as desired to the comfort of the user resting on the mattress. The term foundation is used herein to include a conventional box springs or any such other component of a bed on which a mattress may rest. Of course the foundation may rest on a bed frame or the floor.

The mattress retainer 20 includes a first retaining member 22 that extends between the mattress and the foundation or box springs toward the foot portion 17 of the bed a sufficient distance to make contact with both the mattress and the foundation or box springs to increase the friction sufficiently to prevent slippage of the mattress 14 when the head/back portion 15 of the mattress is raised by inflating the bladder 16. It should be understood that the shape and size of said first retaining member 22 is only limited by the necessity of creating a friction between the mattress and foundation. The first retaining member 22 is attached to a second retaining member 24. The first retaining member 22 may be made of any material and size so long as when it is attached to the second retaining member 24 sufficient friction is present to prevent slippage of the mattress when the head/back is raised.

Figure 2:
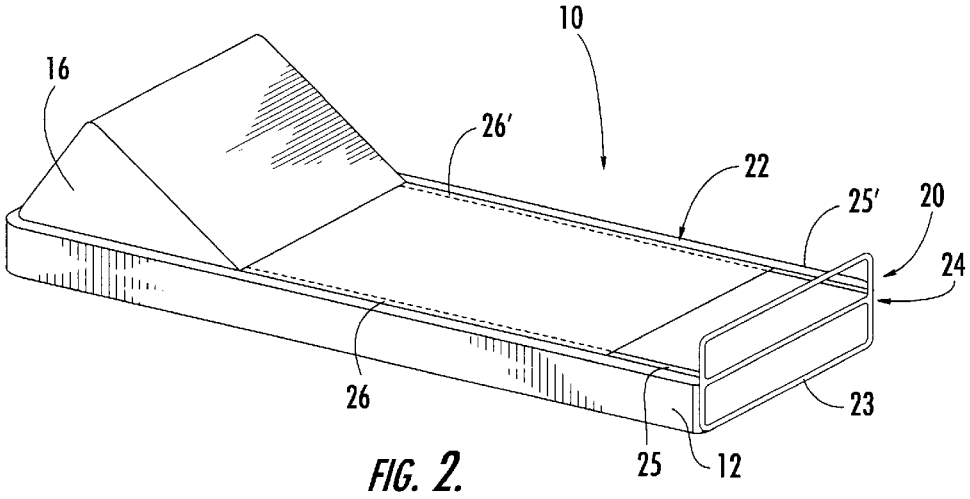
FIG. 2 shows the mattress retainer of FIG. 1 without the mattress and having a rigid second retaining member resting on the bed foundation without the mattress.
Figure 3:
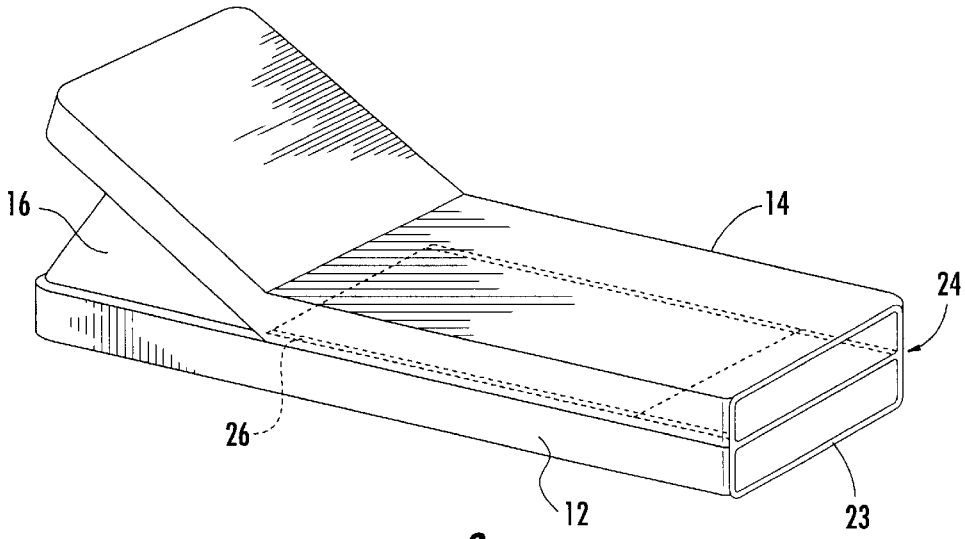
FIG. 3 is a view of the embodiment of FIG. 2 showing the bed with the head/back portion raised and resting on the mattress retainer.

An example of an embodiment of the mattress retainer of the present invention for use on an adjustable bed is shown in FIGS. 2 and 3. In FIG. 2 the mattress retainer 20 is shown laying on foundation 12. The mattress retainer 20 has a first retaining member 22, which may be plurality of straps and in the embodiment shown is a pair of straps 26 26' connected on one end to inflatable bladder 16 and on the other end to the second retaining member 24. It should be understood that any number of straps 26 may be used so long as the size and shape of the straps 26 are sufficient to make contact with both the mattress 14 and the foundation 12 to increase the friction when the head/back portion of the mattress is raised. As shown in FIGS. 2 and 3 the second retaining member 24 is a rigid frame 23 positioned at the end of the foundation 12. The rigid frame may be made of metal tubular material or such other appropriate material. The rigid frame 23 extends downwardly in front of the foot of the foundation 12 and upwardly in front of the mattress 14. In order to properly position the second retaining member 24 supports 25 and 25' are attached to rigid frame 23 and extend outwardly from the rigid frame a suitable length, say 12" to 24". The supports 25 and 25' are attached in a generally perpendicular manner to the middle portion of the rigid frame 23 so as to lay underneath the mattress 14 and attach to straps 26. The first retaining member 22 is attached to a second retaining member 24 by any conventional means.

Figure 4:
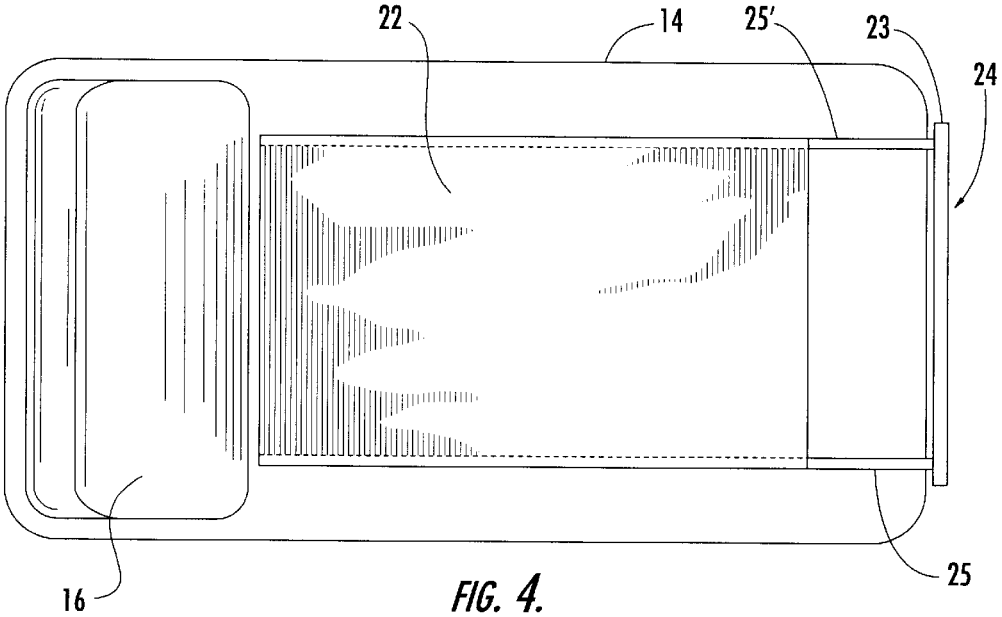
FIG. 4 is a top view showing an embodiment of the mattress retainer of the present invention wherein the first retaining member is a solid sheet of material attached to a rigid second retaining member.

In another embodiment, that shown in FIG. 4, the first retaining member 22 is shown laying on bed foundation 14. The first retaining member 22 is a single sheet of flexible material, such as a fabric or plastic. Like the embodiment of FIGS. 2 and 3, the first retaining member 22 of this embodiment is attached at one end to the second retaining member 24. The first retaining member 22 may, if desired, be attached to the inflatable bladder 16.

Figure 5:
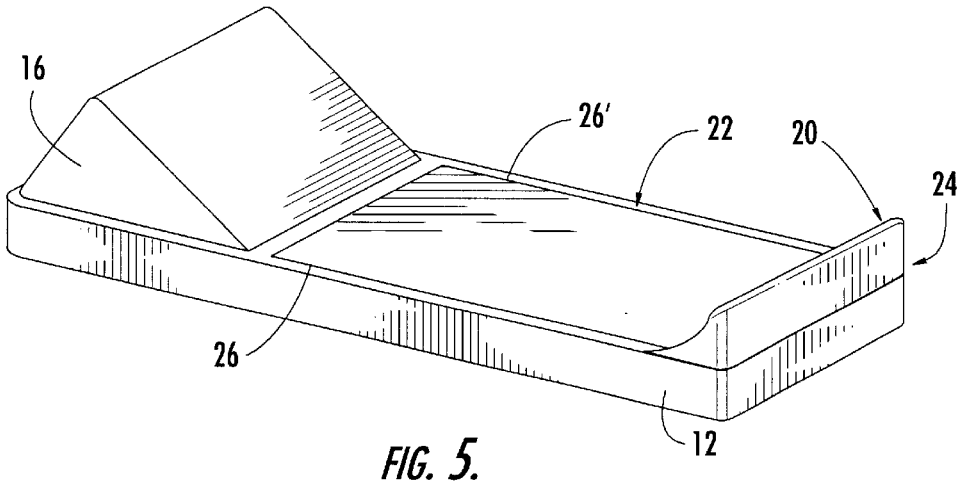
FIG. 5 shows another embodiment of the present invention wherein the first retainer means are two straps attached to the bladder and the second retainer means is a mesh netting encompassing the foot of the mattress.
Figure 6:
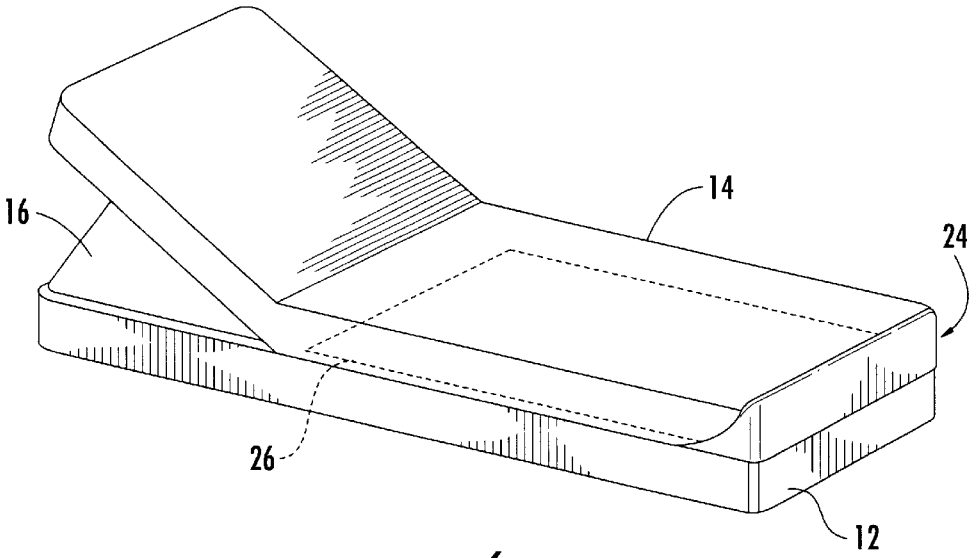
FIG. 6 illustrates the embodiment of FIG. 5 showing the mattress in place over the mattress retaining means.

Another example of the mattress retainer of the present invention is shown in FIGS. 5 and 6. In FIG. 5 the mattress retainer 20 is shown laying on foundation 12. The mattress retainer 20 has a first retaining member 22, which, as shown, a pair of straps 26, 26' connected on one end to inflatable bladder 16 and on the other end to the second retaining member 24. As shown in FIGS. 5 and 6 the second retaining member 24 encircles or encompasses the foot portion of the mattress 14. The second retaining member 24 is attached to the first retaining member 22 and located in the proximity of the foot portion of the mattress 14 for maintaining said mattress in position on said foundation. The second retaining member 24 is made of any material that can be formed to retain the foot of the mattress from slipping. Preferably the second retaining member is made of a mesh or netting material.

Figure 7:
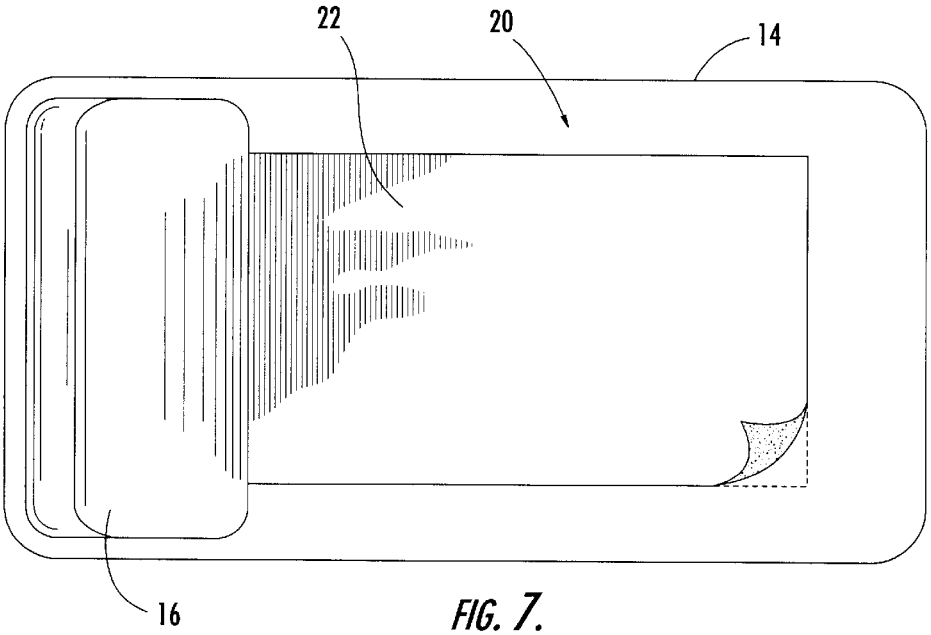
FIG. 7 is a top view illustrating the mattress retaining means of FIG. 5.

Yet another embodiment is shown in FIG. 7 wherein there is shown a mattress retainer 20 laying on bed foundation 16. In this embodiment the first retaining member 22 is a single sheet of fabric or plastic. The first retaining member 22 may be coated with a non-skid material. The first retaining member 22 is attached to the air bladder 16.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A mattress retainer for use on an adjustable bed having a mattress, a foundation, and an air bladder adapted so as to raise the portion of said mattress underlying the user's head and back, said mattress retainer comprising:

a flexible plastic material serving as a first retaining member, said first retaining member being attached to a second retaining member, said second retaining member located in the proximity of the foot portion of said mattress;

said flexible plastic material being dimensioned to extend for a sufficient distance from said second retaining member so that when placed between said mattress and said foundation sufficient friction formed by contact between said flexible plastic material, said mattress, and said foundation is present for maintaining said mattress in position on said foundation when said head/back portion of said mattress is raised.

2. The mattress retainer according to claim 1 wherein said first retaining member is a single sheet of a flexible plastic material.

3. The mattress retainer according to claim 1 wherein said first retaining member is a plurality of straps.

4. The mattress retainer according to claim 1 wherein according to claim 1 wherein said first retaining member is a pair of straps.

5. The mattress retainer according to claim 1 wherein said second retaining member encloses the foot portion of said mattress.

6. The mattress retainer according to claim 1 wherein said second retaining member is a rigid frame.

7. A mattress retainer for use on an adjustable bed having a mattress, a foundation, and an air bladder adapted so as to raise the portion of said mattress underlying the user's head and back, said mattress retainer comprising a retaining member coated with a non-skid material attached to said air bladder and extending for a sufficient distance to make contact with both said mattress and said foundation to increase the friction sufficiently to prevent slippage of the mattress when said head/back portion of said mattress is raised and said retaining member is placed between said mattress and said foundation.

8. An adjustable bed comprising:

a foundation for supporting a mattress;

a mattress;

an inflatable air bladder;

an air supply and controller for regulating the amount of air in said air bladder; and a mattress retainer placed between the mattress and the foundation comprising a flexible plastic material serving as a first retaining member, said first retaining member being attached to a second retaining member, said second retaining member located in the proximity of the foot portion of said mattress said flexible plastic material being dimensioned to extend for a sufficient distance from said second retaining member so that when placed between said mattress and said foundation sufficient friction formed by contact between said flexible plastic material, said mattress, and said foundation is present for maintaining said mattress in position on said foundation when said head/back portion of said mattress is raised.

9. The adjustable bed according to claim 8 wherein said first retaining member is coated with a non-skid material.

10. The adjustable bed according to claim 8 wherein said second retaining member encloses the foot portion of said mattress.

11. The adjustable bed according to claim 8 wherein said second retaining member is a rigid frame.

* * * * *